United States Patent [19]

Maeda

[11] 4,309,116

[45] Jan. 5, 1982

[54] PRINT HEAD ASSEMBLY OF WIRE DOT MATRIX PRINTER

[75] Inventor: Katsumi Maeda, Shizuoka, Japan

[73] Assignee: Star Seimitsu Kabushiki Kaisha, Japan

[21] Appl. No.: 62,982

[22] Filed: Aug. 2, 1979

[30] Foreign Application Priority Data

Aug. 2, 1978 [JP] Japan ..... 53-93659

[51] Int. Cl.[3] ..... B41J 3/12

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 3,592,311 | 7/1971 | Chou et al. | 400/124 |
| 3,690,431 | 9/1972 | Howard | 400/124 |
| 3,802,543 | 4/1974 | Howard | 400/124 |
| 3,837,460 | 9/1974 | Chida et al. | 101/93.05 X |
| 3,991,871 | 11/1976 | McIntosh | 400/124 |
| 4,004,671 | 1/1977 | Kondur | 101/93.05 X |
| 4,091,909 | 5/1978 | Lee | 400/124 |

FOREIGN PATENT DOCUMENTS

| | | | |
|---|---|---|---|
| 52-24456 | 7/1977 | Japan | 400/124 |

*Primary Examiner*—Paul T. Sewell

*Attorney, Agent, or Firm*—Robert E. Burns; Emmanuel J. Lobato; Bruce L. Adams

[57] ABSTRACT

A molded one-piece wire guide which aligns the free ends of a plurality of reciprocating print wires in a given vertical plane which extend from a set of solenoid assemblies disposed in the transverse array. The wire guide comprises first guides which constrain the individual wire so as to suppress a movement thereof in a direction transverse to the reciprocating movement of the print wires, and second guides which constrain the individual wires to suppress a vertical movement thereof.

21 Claims, 6 Drawing Figures

FIG. 4
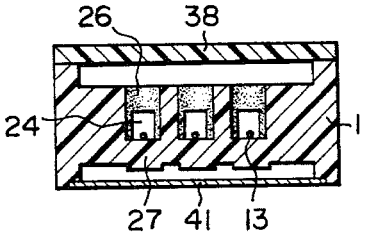
FIG. 5
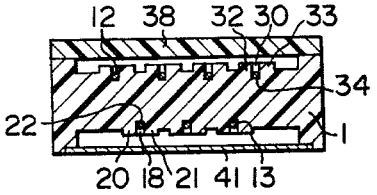
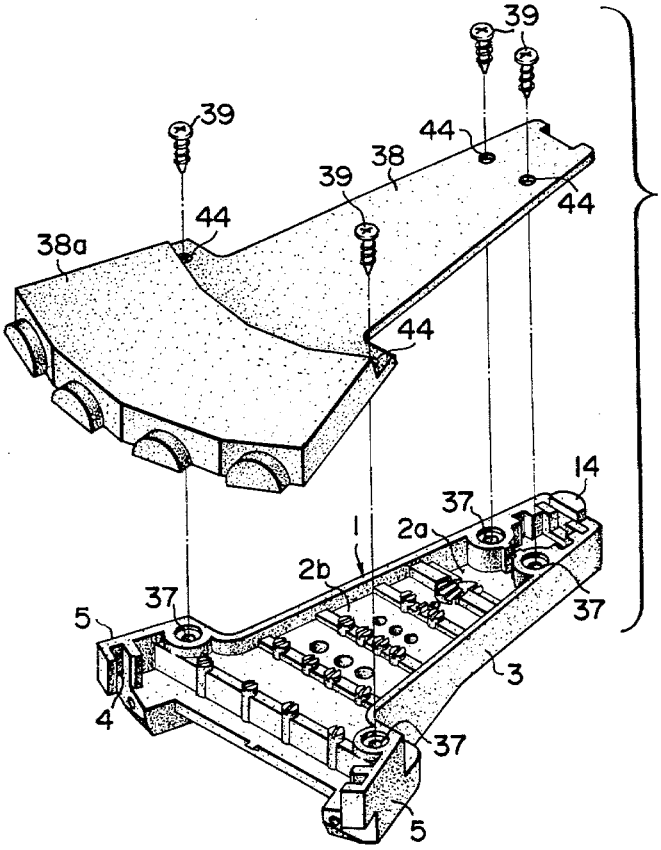
FIG. 6

PRINT HEAD ASSEMBLY OF WIRE DOT MATRIX PRINTER

FIELD OF THE INVENTION

The invention relates to a print head assembly of a wire dot matrix printer, and more particularly, a molded one-piece housing having a guide bearing structure for print wires.

A dot matrix printer is known having a print head assembly which includes seven reciprocating print wires having a sufficiently high stiffness and having their free ends aligned on a given line. In this printer, the free end of selected print wires applies an impact on a record medium at five or seven consecutive positions during the time the print head assembly is driven in a direction perpendicular to the given line, thereby printing a desired letter, numeral or character on the medium. It is ordinary that the free ends of the individual print wires are aligned vertically, and hence in the description to follow, the direction in which the free ends of the print wires are aligned will be referred to as a vertical direction while a direction perpendicular thereto will be referred to as a transverse direction. Similarly, the end of the print head assembly which is close to the record medium will be referred to as a front end while the opposite end will be referred to as a rear end. The print head assembly includes a plurality of solenoid assemblies each associated with one of the print wires. Each solenoid assembly is connected with the rear end of an associated print wire, and is adapted to drive it from a rearward, inoperative position to its front operative position at a high speed and also to reset it. The solenoid assemblies are carried by a rear portion of the housing, and the print wires which extend from these solenoid assemblies extend through guide pipes or bearings which are mounted on the housing.

Seven solenoid assemblies can be located on the housing in various manners. However, a majority of print wires must be flexed in whatever manner the solenoid assemblies are disposed. More closely speaking, the print wires undergo a two-dimensional or three-dimensional flexure, and in most cases, the flexure is three-dimensional. This is because the free ends or end portions of the respective wires must be disposed and terminated in parallel relationship with each other in an imaginary vertical plane which will be referred to hereafter as a vertical reference plane. In a printer in which seven solenoid assemblies are disposed in a radial manner in a common transverse plane, one of the print wires which is associated with a centrally located solenoid assembly can extend along a rectilinear path. This wire may correspond to any numbered dot in the vertical direction, the only requirement being that its axis is located horizontally where it intersects with the vertical reference plane. On the other hand, the remaining six print wires must be flexed vertically, though slightly, in their region adjacent to their free end. They may be flexed only in the transverse direction along the remainder of their respective lengths. The curvature of these print wires in the transverse plane decreases as the wires are further removed from the central print wire, and the endmost print wires will have a minimum radius of curvature. Instead of utilizing a rectilinearly extending print wire, it will be readily understood that print wires may be used which flex in a two-dimensional manner only in a transverse plane. Of those print wires including the rectilinearly extending wire, there is only one wire within the print head assembly which does not flex in the vertical direction. In this connection, a horizontal plane including the axis of this print wire will be referred to as a horizontal reference plane in the following description. Reciprocating print wires which flex in the transverse direction experience a force which is transverse to the direction of their reciprocating movement during the rapid acceleration of the print wires and their impact against a platen through the record medium. The magnitude of such force is inversely proportional to the radius of curvature of the print wires. The same applies to vertically flexed print wires. As a consequence, wire guides or bearings mounted on the housing are subject to a friction, the magnitude of which will increase as the radius of curvature of the print wires supported thereby is reduced.

A printer is also known which includes solenoid assemblies disposed in an upper and a lower set, each set including four or three solenoid assemblies. One set of solenoid assemblies are radially disposed in a common plane so that one of their associated print wires is located in the horizontal reference plane as mentioned above while the other set of solenoid assemblies are disposed in the centripetal manner either above or below the first mentioned set. One of the print wires extending from the other set of solenoid assemblies can be disposed in the vertical reference plane so that it is only subject to a two-dimensional flexure including the vertical direction. However, the remaining print wires must be flexed in both vertical and transverse directions. Another printer is also known including two sets of three solenoid assemblies each, with the remaining solenoid assembly being located on the other side of one set from the other set. The situations which prevail with these print wires will be readily appreciated from the foregoing description. In summary, it is essential that wire guides in the form of guide pipes or bearings be provided on the housing of a print head assembly in order to support the print wires, a majority of which are flexed.

DESCRIPTION OF THE PRIOR ART

U.S. Pat. No. 3,592,311 discloses a wire guide having a molded construction mounted on a frame which carries seven solenoid assemblies radially disposed in a common plane. The wire guide includes a plurality of openings in the form of independent, elongate curved tunnels. It will be evident that such openings cannot be formed unless an upper and a lower piece are joined together.

Japanese Patent Publication No. 52-24456 claiming the Convention priority of U.S. patent application Ser. No. 313,248 filed Dec. 8, 1972 discloses a print head assembly including a one-piece housing which is molded from polycarbonate resin. The housing carries an upper and a lower set of solenoid assemblies and also includes a guide for print wires which extend from these solenoid assemblies. The guide comprises a block which is formed by hardening a compound such as silicone rubber injected into a cavity of the housing, and a plurality of plastic guide pipes embedded into the block. During the assembly, a print wire is passed through each guide pipe, which is then engaged with a respective aperture formed in a plate which defines one of the walls of the cavity, and then placed into the cavity together with the guide plate. When the compound injected into the cavity is hardened, the pipe is set in place.

U.S. Pat. No. 3,690,431 also discloses a molded one-piece housing, which is formed with two pairs of slots in its opposite sidewalls for carrying a pair of positioning plates which engage the slots. Each positioning plate supports one end of a plurality of guide pipes, which are thus fixed in position. Each guide pipe is formed with a tubular opening through which a print wire is passed.

U.S. Pat. No. 3,802,543 proposes the use of a troidal-shaped jewel bearing which is to be substituted for the guide pipe disclosed in U.S. Pat. No. 3,690,431.

Summarizing the prior art, a print head assembly includes guide means in the form of a wire guide having tunnel-shaped openings, guide pipes or troidal-shaped bearings in order to support a plurality of print wires with a low friction. Such guide means is mounted on the housing or frame to be secured thereto during the assembly. While it may readily occur to constrain a wire by passing it through a transverse opening or tubular opening in order to suppress a transverse and/or vertical movement other than the reciprocating movement of the print wire, this prevents a molded one-piece housing from being produced which is complete with a guide bearing construction for the print wires.

SUMMARY OF THE INVENTION

It is an object of the invetion to provide a print head assembly of a wire dot matrix printer which includes a molded one-piece housing having a guide bearing structure for print wires.

It is another object of the invention to provide a print head assembly of a wire dot matrix printer which is simple in construction and easy to assemble.

It is a feature of the invention that a housing is integrally provided with first guide means which constrain individual print wires in order to suppress their movement in a direction transverse to the reciprocating movement thereof, and second guide means which constrain the print wires in order to suppress a vertical movement thereof. The housing includes a floor and a pair of sidewalls. A pair of slots are formed in the rear end of both the sidewalls for receiving a mounting plate therein which supports at least one set of transversely aligned solenoid assemblies. A wire support block having openings which are utilized to align the free end of a plurality of wires extending from the solenoid assemblies in a vertical reference plane is mounted across the front ends of both the sidewalls. The first guide means include projecting means extending vertically from the floor and forming at least two vertically extending bearing surfaces per print wire. The projecting means may be formed as a rib having a plurality of slots opening in its top which receive associated print wires. The inner surface of the opposite sidewalls of each open slot extend vertically to serve as vertical bearing surfaces for an associated print wire. Instead of providing a projecting rib which is common to all of print wires, an independent post may be provided for each print wire. In this instance, the end of each post is formed with an open slot for receiving an associated print wire, the slot forming two vertically extending, opposite bearing surfaces for the print wire.

In a preferred embodiment, three to five pairs of vertical bearing surfaces are formed on the opposite sides of each print wire. In this manner, an array of three to five protecting ribs or posts is formed on the floor of the housing. Instead of providing a plurality of pairs of opposite vertical bearing surfaces, a complementary bearing structure may be formed in which the vertical bearing surfaces on one side are offset from the vertical bearing surfaces on the other side.

The second guide means includes second projecting means which extends vertically from the floor and forming at least one transverse bearing surface per print wire, and third projecting means extending vertically from the floor and forming at least one second transverse bearing surface per print wire. The second projecting means may be formed as a rib having a top which engages all of the print wires, or as a plurality of posts having its end which is adapted to engage an associated print wire. In this instance, the first horizontal bearing surface is defined by the top of the rib or the end of the post. The first horizontal bearing surface may be defined by the bottom wall of an open slot formed in a rib or post which is provided to define the first guide means which constrains a transverse movement of the print wire. The third projecting means may comprise a rib or a plurality of posts which are axially separated from the second projecting means. This rib is formed with a plurality of transverse openings which receive associated print wires. Each opening extends through the floor and opens into the opposite side. These openings can be formed by boring the floor from the opposite side to a diameter greater than the thickness of the rib. The openings have a single transverse wall which serves as the second transverse bearing surface for the print wires. Where a plurality of posts are used, it will be readily apparent that an opening may be formed in each post in the manner mentioned above.

According to another aspect of the invention, there can be provided a print head assembly having another set of solenoid assemblies having their associated print wires disposed on the opposite side of the floor of the housing. In this printer, one set includes three solenoid assemblies while the other set includes four solenoid assemblies. Although the print wires associated with the solenoid assemblies of each set may be guided in the manner mentioned above, a majority of print wires associated with one set of the solenoid assemblies can be located in a horizontal reference plane, thus minimizing undesirable force which cause the print wires to move vertically. As a consequence, the use of the first guide means alone is as a practical matter effective.

Since the housing used in the print head assembly of the invention is not formed with any opening or slot which is open-ended or opens in the transverse direction, the housing can be molded in one piece by employing a pair of an upper and a lower die.

BRIEF DESCRIPTION OF THE DRAWINGS

FIG. 4 is a cross section taken along the line 4—4 shown in FIG. 1;

FIG. 5 is a cross section taken along the line 5—5 shown in FIG. 1;

FIG. 6 is a perspective view of the housing with the top cover removed.

DESCRIPTION OF PREFERRED EMBODIMENT

Figure 1:
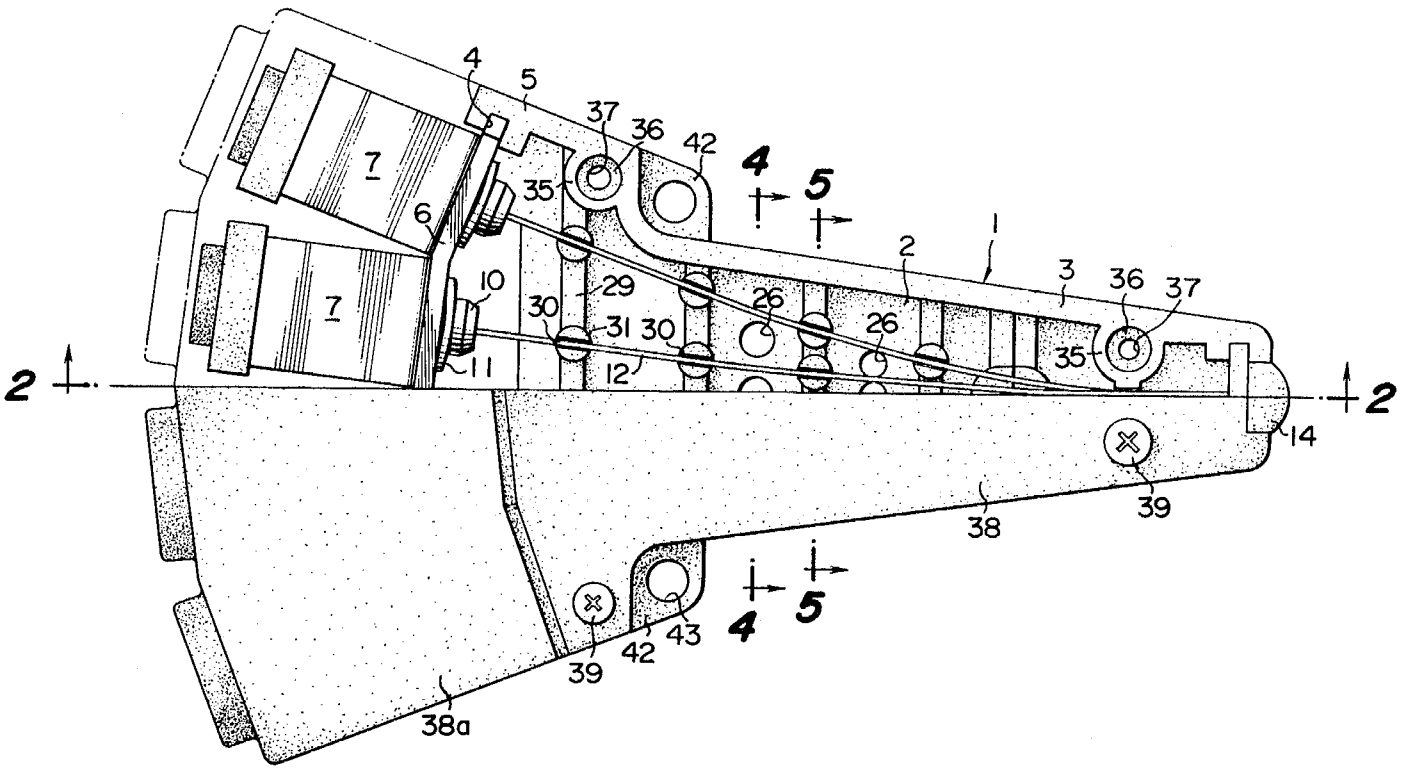
FIG. 1 is a top view of a print head assembly according to the invention, with the top cover being partly broken.
Figure 2:
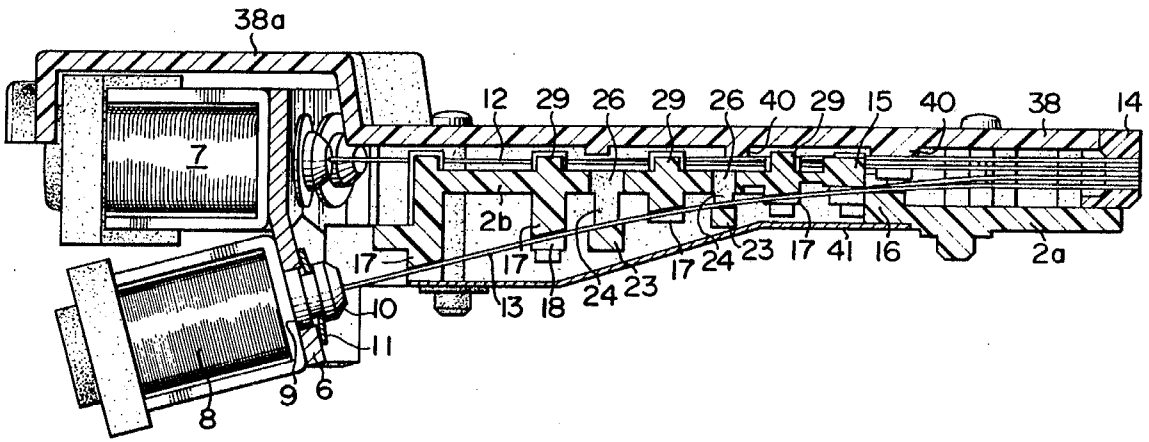
FIG. 2 is a cross section taken along the line 2—2 shown in FIG. 1.
Figure 3:
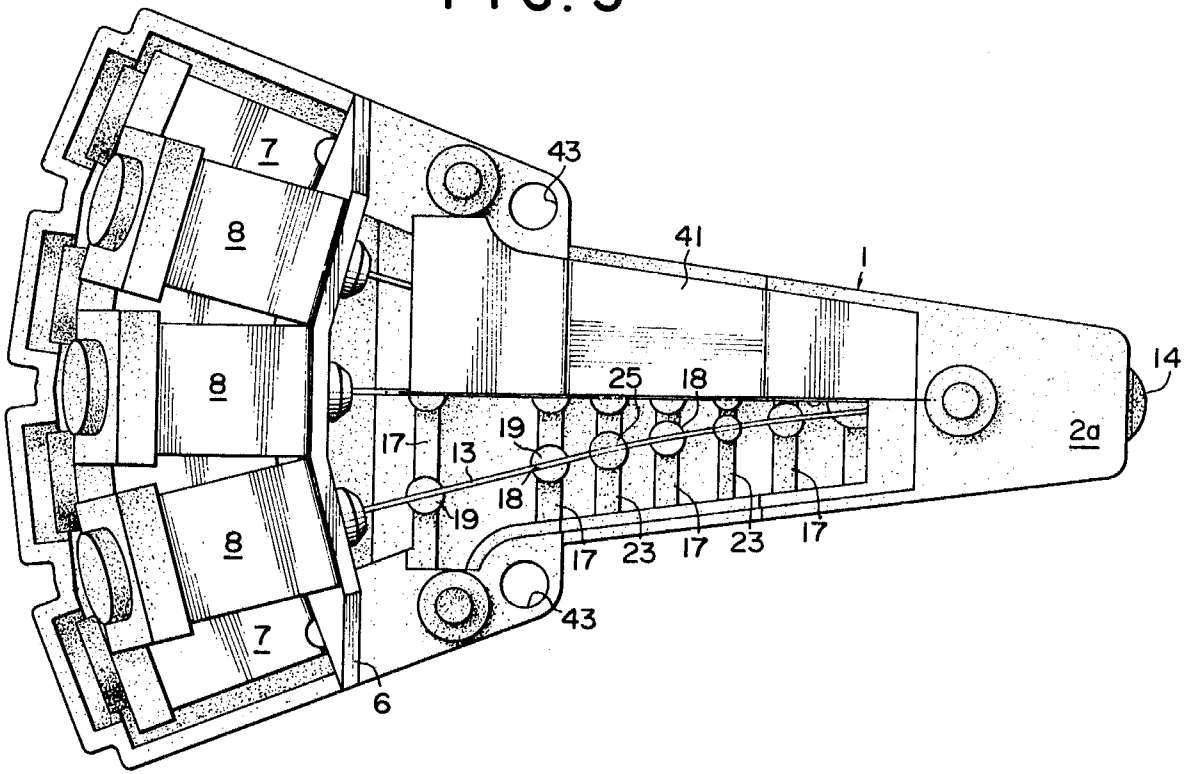
FIG. 3 is a bottom view of the print head assembly, with the lower cover being partly broken.

Referring to FIGS. 1 to 3, the print head assembly of the invention comprises a molded one-piece housing 1 which includes a floor 2 and a pair of sidewalls 3. Each sidewall 3 has an extension having a slot 4 formed in the rear end thereof. These slots 4 receive the opposite ends of a mounting plate 6 which carries an upper and a lower set of solenoid assemblies 7, 8. The mounting plate 6 is formed with a plurality of apertures 9 (see FIG. 2), one each for the solenoid assemblies 7, 8. Each solenoid assembly 7, 8 includes a stem 10 having an annular groove which extends through an associated aperture 9 to project forwardly. By fitting a rigid spring washer 11 in the annular groove, the assembly can be firmly mounted on the plate 6. Each solenoid assembly 7, 8 has a print wire 12, 13 such as a piano wire which has an increased stiffness and which extends through a bore formed in the stem 10 to extend forwardly. A wire support block 14 is mounted across the front ends of the sidewalls 3 for aligning the free end of seven print wires 12, 13 on a predetermined line. Such wire support block 14 is well known, and includes openings which guide the free end of the respective wires 12, 13 horizontally in a vertical reference plane so that when solenoids associated with the individual wires 12, 13 are energized, their free end projects forwardly through the opening to impact a record medium, not shown. Generally, an ink ribbon, not shown, is placed intermediate the block 14 and the record medium. It is recognized that the wire support block 14 is formed of a particular material which is different from that of the housing 1 in order to avoid various problems which are caused by an ink flow along the print wires 12, 13. A suitable material therefor is Teflon fiber polyacetal resin commercially available under the tradename of Delrin AF from E. I. du Pont de Nemours & Co.

Referring to FIG. 2, the floor 2 of the housing 1 includes a forwardly situated depressed portion 2*a* and a rearwardly situated raised portion 2*b*. In the region of rear floor portion 2*b*, the print wires 12 associated with the upper set of the solenoid assemblies 7 are disposed above the print wires 13 associated with the lower set of the solenoid assemblies 8. However, in the region of the front floor portion 2*a*, both sets of the print wires 12, 13 are disposed above the floor. To pass, the print wires 13 flow below the rear floor portion 2*b* to above the front floor portion 2*a*, the front end 15 of the rear floor portion 2*b* terminates in a vertical plane in which the rear end 16 of the front floor portion 2*b* also terminates, thereby forming a channel therebetween to allow the lower print wires 13 to pass therethrough.

Referring to FIG. 3, the lower set of the solenoid assemblies 8 include a central solenoid assembly which is disposed in the vertical reference plane, and a pair of solenoid assemblies which are disposed on the opposite sides thereof. The print wire associated with the central solenoid assembly is flexed only in the vertical direction while the other two print wires are flexed in both vertical and transverse directions. The rear floor portion 2*b* is formed with a set of ribs 17 which extend downwardly and perpendicular to the vertical reference plane and in which three open slots 18 are formed for receiving lower print wires 13 therein, thus suppressing a transverse movement thereof. The slots 18 are formed in the end of circular bulges 19 on the associated ribs 17, with their opposite sidewalls 20, 21 (FIG. 5) presenting a pair of vertical bearing surfaces for the associated lower print wire 13. The bulges 19 are effective in forming vertical bearing surfaces of a width greater than the thickness of the ribs 17. Obviously, the thickness of the ribs 17 may be increased by omitting the bulges 19. Conversely, portions of the ribs 17 located between adjacent bulges 19 may be removed, thus leaving post-shaped projections. In the example shown, the bottom 22 (FIG. 5) of each slot 18 defines a first transverse bearing surface which suppresses a movement of the lower print wire in one of the vertical directions. To suppress a movement of the lower print wire in the other vertical direction, the rear floor portion 2*b* is also formed with another set of ribs 23 which extend downwardly and perpendicular to the vertical reference plane and in each of which three openings 24 (see FIG. 4) are formed to receive the lower print wires 3, thus constraining the latter. Each opening 24 transversely extends through a circular bulge 25 formed on the associated rib 23. As will be apparent from reference to FIGS. 2 and 4, each opening 24 communicates with one of the holes 26 formed in the floor portion 2*b*. The openings 24 and holes 26 can be provided by boring the rear floor portion 2*b* from above to a diameter greater than that of the bulge 25 and to a depth greater than the thickness of the floor portion 2*b*. The opening 24 thus formed is defined by a single transverse wall 27 (FIG. 4) which presents a second transverse bearing surface for the associated lower print wire 13. Where the bulge 25 is omitted and the thickness of the rib 23 is increased instead, the hole 26 is formed to have a diameter which is greater than the thickness of the rib 23. Conversely, portions of the ribs 23 located between adjacent bulges 25 may be removed, thus leaving post-shaped projections. As mentioned previously, a channel is formed between the lower surface of the front end 15 of the rear floor portion 2*b* and the upper surface of the rear end 16 of the front floor portion 2*a* in order to pass lower print wires 13 therethrough. In this instance, the respective surfaces may be positioned so as to engage the lower print wires 13. If these surfaces are located so as to engage the lower print wires 13, it will be appreciated that these surfaces are equivalent in function to the first and the second transverse bearing surface. It is preferred that the first and the second transverse bearing surface be alternately provided, and in the example shown, the sets of ribs 17 and 23 are generally disposed in alternate fashion.

Referring to FIG. 1 again, the upper set of solenoid assemblies 7 include four assemblies, two each disposed on either side of the vertical reference plane. A selected one of the solenoid assemblies of the upper set can be located so that its associated print wire is flexed only transversely in the horizontal reference plane, while the print wires associated with the remaining three solenoid assemblies must be flexed both transversely and vertically. However, these three print wires are essentially flexed in the transverse direction within the horizontal reference plane, and only their free end portion is flexed in the vertical direction also. This vertical flexure is necessary because the free ends of the four print wires which are disposed in the horizontal reference plane must be aligned in the vertical reference plane by being located adjacent to and one above the other. Hence, the curvature for this flexure is very small. For this reason, it is only necessary that a movement of the other print wires 12 in directions transverse to their reciprocating movement be suppressed. Hence, the rear floor portion 2*b* is formed with a set of upper ribs 29 extending perpendicular to the vertical reference plane. Each rib 29 is formed with four open slots 30 which allow associated upper print wires 12 to pass therethrough. Each slot 30 is formed on the end of a circular bulge 31 on the rib 29, with its opposite sidewalls 32, 33 (see FIG. 5) presenting a pair of vertical bearing surfaces for the associated print wire 12. Again, the bulge 31 is optionally provided to present vertical bearing surfaces having a greater width than the thickness of the rib 29. Conversely, portions of the ribs 29 located between adjacent bulges 31 may be removed, thus leaving post-shaped projections. The bottom 34 (FIG. 5) of each slot 30 presents a transverse bearing surface for the associated print wire 12.

The both sidewalls 3 of the housing 1 are formed with studs 35, defining bores which frictionally support short rods 36 each having a threaded bore 37 (FIG. 1). The threaded bores 37 receive screws 39 which are passed through the opening 44 formed in a top cover 38 that is mounted on top of the housing 1. The top cover 38 includes an extension **38*a* which extends over the upper set of solenoid assemblies 7. In the example shown, the top cover 38 is formed with a plurality of projections 40 (see FIG. 2), the end of which engages upper print wires 12, serving as a transverse bearing surface which suppresses a movement of these print wires in one of the vertical directions. However, it should be understood that these projections 40 are provided for the purpose of assuring a satisfactory guide of the upper print wires 12, but that their provision is not essential. A lower cover 41 is secured to the underside of the housing 1 by adhesion. The housing is also provided with a pair of mounting flanges 42 which extend laterally from the opposite sidewalls 3 and formed with an aperture 43. By utilizing the mounting flange 42**, the print head assembly is mounted on a movable carriage which is in itself known.

As will be apparent from the foregoing description, the housing 1 is not provided with any opening or recess which opens in the transverse direction, so that it can be easily molded by utilizing a pair of upper and lower dies. A molding material should be chosen which has an abrasion resistance and a heat resistance inasmuch as the housing 1 defines bearing surfaces for the print wires 12, 13. Preferred materials include polyacetal resin, nylon 6 or 66, polybutylene terephthalate, although the material used is not limited thereto.

During the assembly, the mounting plate 6 is initially fitted into the slots 4 which are formed in both the extensions 5 of the housing 1, and secured in place as by adhesion. Subsequently, the solenoid assemblies 7, 8 are mounted one by one on the mounting plate 6. At this assembly stage, the top cover 38 and the lower cover 41 are not yet attached, jigs are placed along the upper and lower sides of the floor 2 in order to guide the print wires 12, 13 along predetermined paths into the wire support block 14. Suitable jigs can be readily chosen, and therefore will not be described in detail. However, each jig includes a plurality of ribs having slots formed therein which guide the print wires 12, 13 along the predetermined paths. These ribs fit in between the ribs 17, between the ribs 17 and the ribs 23, and between the upper ribs 29 on the floor 2. In this manner, the print wires 12, 13 can be easily led into the wire support block 14. After the assembly of all the solenoid assemblies 7, 8 is completed, the jigs are removed, and the top cover 38 and the lower cover 41 are fixedly mounted on the housing 1. A highly viscous silicone oil may be applied to the individual bearing surfaces by a conventional manner prior to mounting the covers 38, 41.

What is claimed is:

1. A print head assembly of a wire dot matrix printer comprising: a housing including a floor and a pair of sidewalls, at least one set of solenoid assemblies carried by a rear portion of the housing and disposed in a transverse array, each solenoid assembly including a print wire extending forwardly along one side of the floor, the solenoid assembly being effective to drive the associated print wire between a rear inoperative position and a forward operative position, and a wire support block supported on a front portion of the housing for aligning the free ends of the respective print wires in a given vertical reference plane, the housing including first guide means which constrain the individual print wires in order to suppress a movement thereof in a direction transverse to their reciprocating movement, and second guide means which constrain the individual print wires in order to constrain a movement thereof in a vertical direction which is aligned with the vertical reference plane, wherein the first guide means comprises first projecting means which vertically extends from the floor of the housing for forming at least two vertical bearing surfaces per print wire, and wherein the second guide means comprises second projecting means extending vertically from the floor of the housing for forming at least one first transverse bearing surface per print wire facing away from the housing floor, and third projecting means extending vertically from the floor of the housing and formed with a plurality of openings each corresponding to a respective print wire for allowing the corresponding print wire to pass therethrough, each of the openings being formed by boring the floor from the opposite side of the third projecting means to a diameter which is greater than the thickness of the third projecting means in the direction of the elongated associated print wire and to a depth which is greater than the thickness of the floor, each of the openings through the third projecting means defining a second transverse bearing surface for the print wire extending therethrough and facing toward the housing floor.

2. A print head assembly according to claim 1 in which the first projecting means comprises a plurality of posts each formed with an open slot which receives an associated print wire, the opposite inner sides of each slot defining the two vertical bearing surfaces.

3. A print head assembly according to claim 1 in which the second projecting means comprises a plurality of posts each formed with an open slot which receives an associated print wire, the bottom surface of each slot defining the first transverse bearing

4. A print head assembly according to claim 1, in which the third projecting means comprises a plurality of posts each formed with an opening which receives an associated print wire, each opening being formed by boring the floor from the opposite side to a diameter greater than that of the posts and to a depth greater than the thickness of the floor, the transverse inner surface of the opening defining the second transverse bearing surface.

5. A print head assembly according to claim 1 in which the second and the third projecting means are separated by a gap therebetween.

6. A print head assembly according to claim 1 in which the second and the third projecting means are closely spaced from each other and have their one side located in a common horizontal plane.

7. A print head assembly of a wire dot matrix printer comprising: a housing including a floor and a pair of sidewalls, at least one set of solenoid assemblies carried by a rear portion of the housing and disposed in a transverse array, each solenoid assembly including a print wire extending forwardly along one side of the floor, the solenoid assembly being effective to drive the associated print wire between a rear inoperative position and a forward operative position, and a wire support block supported on a front portion of the housing for aligning the free ends of the respective print wires in a given vertical reference plane, the housing including first guide means which constrain the individual print wires in order to suppress a movement thereof in a direction transverse to their reciprocating movement, and second guide means which constrain the individual print wires in order to constrain a movement thereof in a vertical direction which is aligned with the vertical reference plane, wherein the first guide means comprises first projecting means which vertically extends from the floor of the housing for forming at least two vertical bearing surfaces per print wire, and wherein the second guide means comprises second projecting means extending vertically from the floor of the housing for forming at least one first transverse bearing surface per print wire, and third projecting means extending vertically from the floor of the housing for forming at least one second transverse bearing surface per print wire, in which at least one of the first and the second projecting means comprises a rib having a plurality of open slots formed therein which receive the associated print wires, the opposite inner sides of each slot defining the two vertical bearing surfaces.

8. A print head assembly of a wire dot matrix printer comprising: a housing including a floor and a pair of sidewalls, at least one set of solenoid assemblies carried by a rear portion of the housing and disposed in a transverse array, each solenoid assembly including a print wire extending forwardly along one side of the floor, the solenoid assembly being effective to drive the associated print wire between a rear inoperative position and a forward operative position, and a wire support block supported on a front portion of the housing for aligning the free ends of the respective print wires in a given vertical reference plane, the housing including first guide means which constrain the individual print wires in order to suppress a movement thereof in a direction transverse to their reciprocating movement, and second guide means which constrain the individual print wires in order to constrain a movement thereof in a vertical direction which is aligned with the vertical reference plane, wherein the first guide means comprises first projecting means which vertically extends from the floor of the housing for forming at least two vertical bearing surfaces per print wire, and wherein the second guide means comprises second projecting means extending vertically from the floor of the housing for forming at least one first transverse bearing surface per print wire, and third projecting means extending vertically from the floor of the housing for forming at least one second transverse bearing surface per print wire, another set of solenoid assemblies carried by a rear portion of the housing and disposed in a transverse array, each solenoid assemblies of the another set including a print wire which extends forwardly along the other side of the floor and driving it between a rear inoperative position and a forward operative position, and third guide means which constrain the print wires associated with the solenoid assemblies of the other set to suppress a movement thereof in a direction transverse to the reciprocating movement thereof, and in which the wire support block is operative to align the free ends of the print wires associated with the another set of solenoid assemblies in the vertical reference plane together with the free ends of the print wires associated with the first mentioned set of solenoid assemblies.

9. A print head assembly according to claim 8 in which the third guide means comprises fourth projecting means extending from the other side of the floor of the housing and forming at least two vertical bearing surfaces per print wire associated with the other set of solenoid assemblies.

10. A print head assembly according to claim 9 in which the fourth projecting means comprises a rib having a plurality of open slots formed therein which receive the associated print wires, the opposite inner sides of each slot defining the two vertical bearing surfaces.

11. A print head assembly according to claim 9 in which the fourth projecting means comprises a plurality of posts each formed with an open slot which receives an associated print wire, the opposite inner sides of each slot defining the two vertical bearing surfaces.

12. A molded one-piece wire guide for aligning the free ends of a plurality of reciprocating print wires in a given vertical reference plane which extend from at least one set of solenoid assemblies disposed in a transverse array, the wire guide comprising a floor, first projecting means extending from one side of the floor and defining at least two vertical bearing surfaces per print wire, second projecting means extending from said one side of the floor and defining at least one first transverse bearing surface per print wire, third projecting means extending from said one side of the floor and formed with a plurality of openings each corresponding to a respective print wire for allowing the corresponding print wire to pass therethrough, each of the openings being formed by boring the floor from the opposite side of the third projecting means to a diameter which is greater than the thickness of the third projecting means in the direction of the elongated associated print wire and to a depth which is greater than the thickness of the floor, each of the openings through the third projecting means defining a second transverse bearing surface for the print wire extending therethrough and facing toward the housing floor, said two vertical bearing surfaces being located on the opposite sides of an associated print wire, the first and the second transverse bearing surface being located on the opposite sides of an associated print wire, thereby constraining the print wire so as to suppress a movement thereof in a direction transverse to the direction of reciprocating movement thereof and to suppress a movement thereof in the vertical direction.

13. A wire guide according to claim 12 in which the first and the second transverse bearing surface are spaced apart lengthwise of the associated print wire.

14. A molded one-piece wire guide for aligning the free ends of a plurality of reciprocating print wires in a given vertical plane which extend from a set of solenoid assemblies disposed in a transverse array, the wire guide comprising a floor, a first set of ribs extending from one side of the floor and having a plurality of open slots formed therein in the top thereof which receive associated print wires, another set of ribs extending from said one side of the floor and formed with a plurality of openings which allow the associated print wires to pass therethrough, each of the openings being formed by boring the floor from the opposite side to a diameter which is greater than the thickness of the associated ribs and to a depth which is greater than the thickness of the floor, each of the slots defining two vertical bearing surfaces located on the opposite sides of an associated print wire and a first transverse bearing surface facing away from the wire guide floor, each of the openings defining a second transverse bearing surface for the associated print wire and facing toward the wire guide floor.

15. A wire guide according to claim 14 in which the first mentioned set of ribs and said another set of ribs are disposed in alternate fashion.

16. In a print head:

(a) a first array of print wires movable along their respective longitudinal dimensions to effectuate printing;

(b) a second array of print wires movable along their respective longitudinal dimensions to effectuate printing;

(c) and a one piece body having a pair of opposite major surfaces with said first array of print wires disposed opposite a first of said major surfaces and said second array of print wires disposed opposite the second of said major surfaces, said body having first guide means on said first major surface for guiding said print wires comprising said first array for movement along their respective longitudinal dimensions to effectuate printing, said first guide means having guide surfaces defining open slots opening away from said first major surface and spaced along respective paths of travel of said print wires comprising said first array, and said print wires comprising said first array each being disposed within the open slots defining its respective path of travel to constrain said print wires comprising said first array for movement only along their respective longitudinal dimensions, said body having second guide means on said second major surface for guiding said print wires comprising said second array for movement along their respective longitudinal dimensions to effectuate printing, said second guide means having guide surfaces defining open slots opening away from said second major surface and spaced along respective paths of travel of said print wires comprising said first array, and said print wires comprising said first array each being disposed within the open slots defining its respective path of travel to constrain said print wires comprising said second array for movement only along their respective longitudinal dimensions, and said body having third guide means on said second major surface for guiding said print wires comprising said second array for movement along their respective longitudinal dimensions to effectuate printing, said third guide means having guide surfaces facing said second major surface and spaced along respective paths of travel of said print wires comprising said second array for preventing said print wires from moving transversely of their longitudinal dimensions away from said second major surface as said print wires comprising said second array move in the directions of their longitudinal dimensions, and said guide surfaces of said second guide means and said guide surfaces of said third guide means alternately disposed along the length of said print wires comprising said second array.

17. In a print head according to claim 16, said first guide means comprising a plurality of projections extending from said first major surface toward said print wires comprising said first array, said projections having said guide surfaces defining the open slots opening away from said first major surface.

18. In a print head according to claim 17: said one piece body further includes a pair of side walls extending from said first major surface each disposed on an opposite side of said first array of print wires and each extending generally along the longitudinal directions of said print wires comprising said first array; and a cover mounted on said pair of side walls and covering said first array of print wires, said cover including surfaces facing said first array of print wires for holding said print wires within the open slots of said first guide means.

19. In a print head according to claim 16, 17 or 18: a wire support block for supporting respective ends of said print wires comprising said first and said second arrays of print wires for aligning said respective ends of said print wires generally normal to said first and second major surfaces of said print head body; and said first, second and third guide means are effective to position said print wires comprising said first array substantially within a plane oriented generally parallel to said first major surface and to position said print wires comprising said second array substantially within a plane oriented generally parallel to said second major surface.

20. In a print head according to claim 16: said second guide means comprising a plurality of projections extending from said second major surface toward said print wires comprising said second array, said projections having said guide surfaces defining the open slots opening away from said first major surface.

21. In a print head according to clam 16: said third guide means comprising a plurality of projections extending from said second major surface toward said print wires comprising said second array and disposed alternately with said projections comprising said second guide means, said projections comprising said third guide means having guide surfaces defined by bores extending through said print head body from the first major surface to the second major surface of said print head body and into said projections comprising said third guide means and opening along the respective paths of travel of said print wires comprising said second array.

* * * * *